United States Patent [19]

Orr, Jr.

[11] Patent Number: 4,808,771

[45] Date of Patent: Feb. 28, 1989

[54] HINGE-LINE MULTILAYER CABLE AND METHOD

[76] Inventor: Lawrence W. Orr, Jr., 103 Maple Wind La., Simpsonville, S.C. 29681

[21] Appl. No.: 124,019

[22] Filed: Nov. 23, 1987

[51] Int. Cl.[4] ..... H01B 7/08; H01B 13/00

[52] U.S. Cl. ..... 174/72 R; 139/425 R; 174/72 TR; 174/117 M

[58] Field of Search ..... 174/72 R, 72 TR, 117 M; 139/425 R

[56] References Cited

U.S. PATENT DOCUMENTS

| | | | |
|---|---|---|---|
| 3,447,120 | 5/1969 | Rask et al. | 174/117 M |
| 3,495,025 | 2/1970 | Ross | 174/117 M |
| 3,582,537 | 6/1971 | Perreault | 174/117 M |
| 3,627,903 | 12/1971 | Plummer | 174/117 M |
| 3,646,247 | 2/1972 | Sennett et al. | 174/117 M |
| 3,984,622 | 10/1976 | Ross | 174/117 M X |
| 4,159,394 | 6/1979 | Ross | 174/117 M X |
| 4,229,615 | 10/1980 | Orr, Jr. et al. | 174/117 M |

FOREIGN PATENT DOCUMENTS

| | | | |
|---|---|---|---|
| 30493 | 3/1979 | Japan | 174/72 R |

*Primary Examiner*—Morris H. Nimmo
*Attorney, Agent, or Firm*—Cort Flint

[57] ABSTRACT

A woven electrical transmission cable is disclosed which may be flat (A) or multilayered (A'). The cable consists of a plurality of woven cable sections (B, C, D). Each cable section is formed from weft yarn (12) interwoven with warp yarns (14, 18, 22). Longitudinal electrical warp conductors (10, 16, 20) are bound by the weave pattern in each woven cable section (B, C, D) respectively. Hinge lines (30, 32) woven between adjacent cable sections allow the cable to be folded in a multilayered configuration with branches (B', C', D') broken out from each layer.

14 Claims, 3 Drawing Sheets

HINGE-LINE MULTILAYER CABLE AND METHOD

BACKGROUND OF THE INVENTION

The invention relates to multi-conductor cable for the transmission of high speed electrical signals. More particularly, the invention relates to woven electrical transmission cable having a plurality of electrical conductors bound in a prescribed weave pattern which may be folded into multiple layers with breakouts for making selected terminations.

Electrical transmission cables have been made in laminated cables and woven cables. In the laminated construction, the conductors are arranged in a desired pattern and encapsulated in a suitable material such as Teflon or other polymeric material. Woven electrical transmission cables typically include warp and weft yarns interwoven with electrical conductors in various configurations and patterns. In addition to interweaving conductors, it has been known to weave harnesses about the conductors wherein interweaving does not actually occur between the warp and weft yarns and the conductors, but jackets and other arrangements are woven about the conductors to harness them in a prescribed manner. U.S. Pat. No. 3,984,622 discloses a multi-conductor cable harness having breakouts occurring at successive stages of the harness cover. It has also been known to form branches off of a main trunk section of a cable by severing weft elements forming a plastic sheath as disclosed in U.S. Pat. No. 3,627,903. The use of hinge lines is also known, for example, disclosed in U.S. Pat. No. 3,495,025 wherein a narrow web containing no conductors is woven between adjacent sections of conductors. Cut line cable is disclosed in U.S. Pat. No. 4,159,394 which separates conductors into two sections that may be cut along the cut line with the severed sections remaining intact due to the weave pattern. Cables stacked upon one another in a superposed manner is disclosed in U.S. Pat. No. 3,447,120.

While the above woven electrical transmission cables are illustrative of the numerous types of specialized cable which have been provided for special applications, it is desirable to provide a single cable woven so as to be foldable into multiple layers for compactness and having breakouts which may be expeditiously used in the multilayer configuration for termination at selected intervals.

Accordingly, an important object of the invention is to provide a woven electrical transmission cable which is simple in construction and yet may be used in a variety of configurations.

Another object of the invention is to provide a woven electrical transmission cable which may be used in a flat configuration with breakouts or may be used in a stacked multilayer configuration with breakouts for routing of conductors in a variety of applications.

Still another object of the present invention is to provide a woven cable and method in which individual warp conductors may be bound in a prescribed weave pattern and broken out from the pattern in either a flat or a multiple layer configuration for use in a variety of applications.

SUMMARY OF THE INVENTION

The above objectives are accomplished according to the present invention by providing a woven electrical transmission cable having a plurality of electrical conductors for programmed termination in either a single layer or multilayer configuration. The cable includes a plurality of hinged woven longitudinal hinged cable sections which include longitudinal electrical conductors extending in a warp direction woven with warp and weft yarns in a prescribed weave pattern. A hinge-line is woven between each of the woven sections about which adjacent woven sections may be folded generally flat upon each other in a superposed position to form a stacked multilayer cable. A plurality of conductor branches are broken out from the woven sections at selected lengths of the cable in which said longitudinal conductors are unbound with warp and weft strands for making programmed termination.

The present invention also includes a method of constructing a woven electrical transmission cable having a plurality of electrical conductors for programmed termination in either a single layer or multilayer configuration. The method comprises weaving warp and weft yarns in a prescribed weave pattern to bind said electrical conductors extending in a warp direction in the cable. The cable is woven to include a plurality of individual woven cable sections across the width of the cable and extending longitudinally in the cable. Weft and warp yarns are woven in adjacent cable sections 180 degrees out of phase with respect to each other so that one section is being woven while an adjacent section is not being woven. Criss-crossing of the top and bottom picks of said weft yarn between adjacent sections form a hinge-line. The method further includes forming conductor branches by breaking out the electrical conductors from each woven cable section in a generally unbound configuration. The conductors are not woven, but the remaining conductors are bound with warp and weft yarns in remaining woven cable sections.

DESCRIPTION OF THE DRAWINGS

The construction designed to carry out the invention will hereinafter be described, together with other features thereof.

The invention will be more readily understood from a reading of the following specification and by reference to the accompanying drawings forming a part thereof, wherein an example of the invention is shown and wherein.

DESCRIPTION OF A PREFERRED EMBODIMENT

Figure 1:
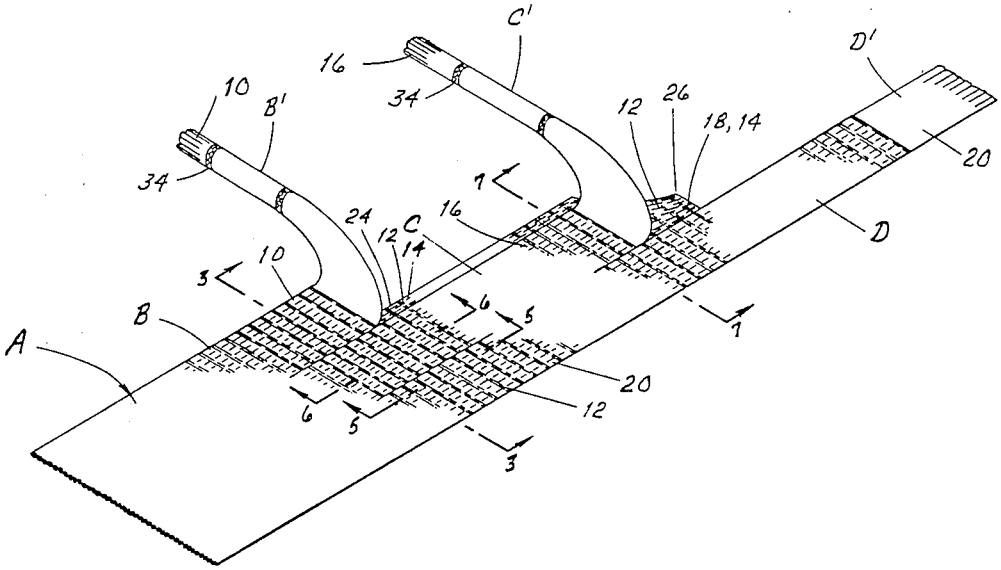
FIG. 1 is a perspective view illustrating a woven electrical transmission cable and method according to the invention.

Referring now in more detail to the drawings, a woven electrical transmission cable is illustrated at A which includes a plurality of woven sections B, C, and D arranged in a side-by-side manner. Woven cable section B includes a plurality of conductors 10 woven in a prescribed weave pattern such as a box weave wherein weft yarn 12 is woven in top and bottom runs over conductors 10 with warp yarns 14 being woven from between top and bottom runs 12*a* and 12*b*, respectively, of weft yarn 12, as can best be seen in FIG. 3. Woven cable section C includes conductors 16 woven with warp yarns 18 and weft yarn 12 in the same weave pattern. Woven cable section D includes conductors 20 woven with warp yarns 22 and weft yarn 12 in the same weave pattern. It is to be understood, of course, that other weave patterns may also be possibly used without departing from the scope and spirit of the present invention. While weft yarn 12 is illustrated as a single weft yarn woven continuously in alternating picks, it may be possible that multiple weft yarn systems may also be used with various other weave patterns. Preferably, conventional insulated conductors are used in the cable which may be either straight or twisted pair conductors.

Figure 2:
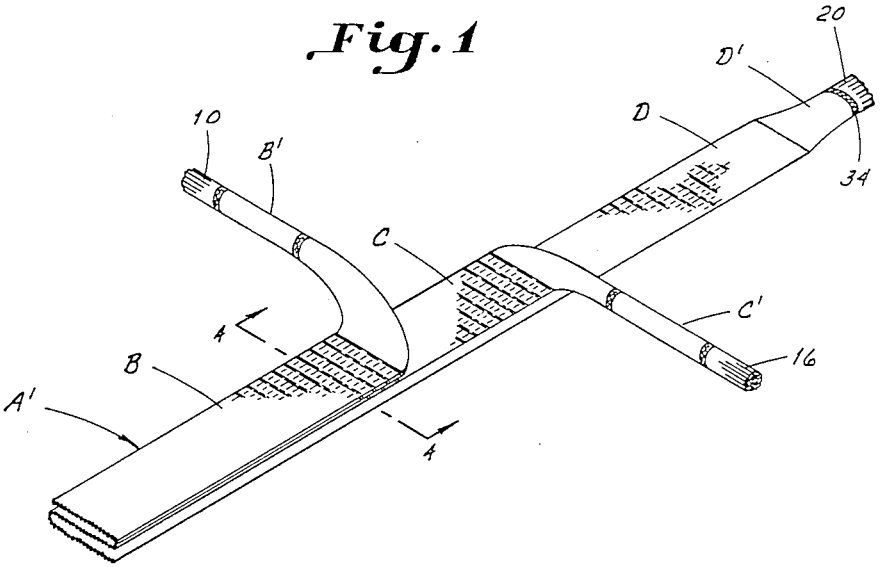
FIG. 2 is a perspective view illustrating a woven electrical transmission cable and method according to the invention with the cable being folded to a multilayer configuration.

As can best be seen in FIGS. 1 and 2, a branch B′ of conductors 10 is broken out from cable section B along the length of cable A. A branch C′ of conductors 16 is broken out from cable section C. A branch D′ of conductors 20 is broken out from cable section D at the terminal end of cable A. Branch B′ includes only conductors 10 without being bound with warp and weft yarns. Warp yarns 14 of cable section B continue to be woven with weft yarn 12 after conductors 10 are broken out in the form of a woven selvage 24. Woven selvage includes warp yarns 14 and weft 12. Selvage 24 continues to be woven along the edge of cable section C until conductors 16 are broken out from cable section C at which time a woven tab 26 is woven. Woven tab 26 includes warp yarns 14 from section B and warp yarns 18 from section C woven together with weft yarn 12. Warp yarns 18 and 14 discontinue weaving with cut-off tab 26. Section D continues with warp yarns 22 woven with weft yarn 12 to bind conductors 10.

Figure 3:
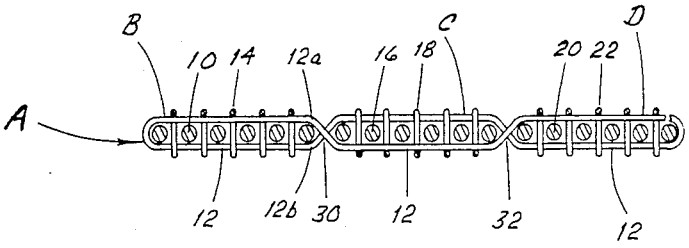
FIG. 3 is a sectional view taken along line 3—3 of FIG. 1.
Figure 4:
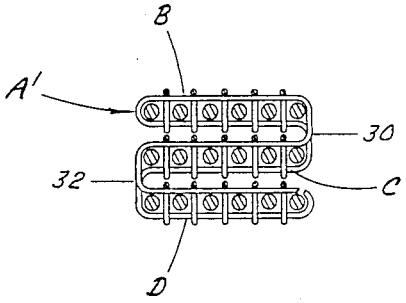
FIG. 4 is a sectional view taken along line 4—4 of FIG. 2.

As can best be seen in FIGS. 3 and 4, a hinge line is formed between each adjacent cable section B, C, and D for folding. There is a hinge line 30 between sections B and C. There is a hinge line 32 between sections C and D. Each hinge line is formed by crossing the weft yarn 12 over and under. Referring to FIG. 3, it can best be seen that top run 12*a* of weft yarn 12 passes from the top of section B to the bottom of section C. At the same time, bottom run 12*b* crosses from the bottom of section B to the top of section C. Each pick of weft yarn 12 in cable A passes over a section, under the next section, and then over the next section, as can best be seen in FIG. 3. On the alternate pick, weft yarn 12 passes from the bottom, to the top, and then to the bottom of the next section. The weft yarn crosses at each section on each pick in the cable.

As can best be seen in FIGS. 2 and 4, it can be seen that cable sections B, C, and D may be folded about hinge lines 30 and 32 to form a compact multilayered cable A′ with breakouts or branches. In reference to FIG. 1, it can be seen that branches B′ and C′ previously extending in the same direction break out in opposite directions when the cable is configured as multilayer cable A′.

In accordance with the method of the present invention, cable sections B, C, and D of woven electrical transmission cable A are woven simultaneously for a predetermined length of cable A. Next, conductors 10 are broken out in branch B′. Warp yarns 14 continue to be woven with weft yarn 12 and selvage 24 while cable sections C and D continue to be woven. Next, branch C′ is broken out with conductor 16. Woven cut-off tab 26 is formed by warp yarns 18, 14 and weft 12. Cable section D continues to be woven with warp yarns 14 and conductors 10 bound with weft 12. Finally, the weaving of warp and weft yarns 14 and 12 is terminated and branch of conductors D′ is formed. Each branch B′, C′, and D′ may be harnessed by a plurality of bands 34 which may be severed when it is desired to work with the individual wires for termination.

Figure 5:
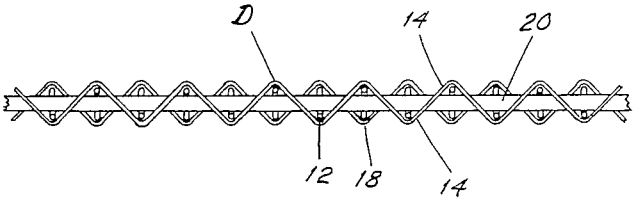
FIG. 5 is a sectional view taken along line 5—5 of FIG. 1.
Figure 6:
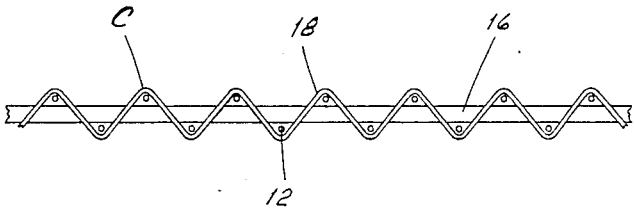
FIG. 6 is a sectional view taken along line 6—6 of FIG. 1.
Figure 7:
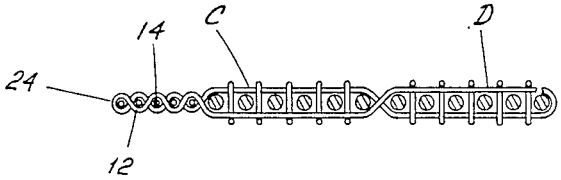
FIG. 7 is a sectional view taken along line 7 of FIG. 1 which coincides with a hinge-line.

As can best be seen in FIGS. 5 and 6, representing a longitudinal section of adjacent cable sections D and C, sections D and C are woven oppositely. That is the warp elements, yarns 18 and conductors 16, of section C are up and not weaving while section D is down and weaving. Alternating cable sections weave while the in between section is not. Thus sections B and D are down and weaving while section C is up, and sections B and D are up while section C is down and weaving.

While a preferred embodiment of the invention has been described using specific terms, such description is for illustrative purposes only, and it is to be understood that changes and variations may be made without departing from the spirit or scope of the following claims.

What is claimed is:

1. A woven electrical transmission cable having a plurality of electrical conductors for programmed termination in either a single layer or multilayer configuration, comprising:

(a) a plurality of woven longitudinal hinged cable sections which include longitudinal electrical conductors extending in a warp direction woven with warp and weft yarns in a prescribed weave pattern;

(b) a hinge-line woven between each of said woven sections about which adjacent woven sections may be folded generally flat upon each other in a superposed position to form a stacked multilayer cable; and (c) a plurality of conductor branches broken out from said woven sections at successive selected lengths of said cable in which said longitudinal conductors are unbound with said warp and weft yarns for making programmed termination, and said warp and weft yarns continuing to be woven in the other of said woven sections at successive selected lengths of said cable.

2. The cable of claim 1, wherein said hinge-line is formed by crossing adjacent picks of said weft yarn over and under adjacent woven sections of said hinge.

3. The cable of claim 1 including a selvage following a first woven section formed by said warp and weft yarns woven adjacent the marginal edge of a second woven section following the formation of a first conductor branch.

4. The cable of claim 1, wherein said hinge-line is formed by crossing each pick of said weft yarn alternately over and under successively next adjacent cable sections.

5. A woven electrical transmission cable having a plurality of electrical conductors for programmed termination in either a single layer or multilayer configuration, comprising:

(a) a plurality of woven cable sections extending longitudinally in said cable which include a plurality of elongated electrical conductors bound with warp and weft yarns in a prescribed weave pattern;

(b) a hinge-line woven between each of said woven cable sections to facilitate folding of said sections in a generally flat manner on top of each other;

(c) a conductor branch formed from each of said woven cable sections at successive lengths of said cable which includes said electrical conductors not woven with said warp and weft yarns while continuing to weave said warp and weft yarns in the other of said cable sections at successive lengths of said cable and (d) a plurality of cable layers defined by said woven cable sections being foldable about said hinged lines to lie on top of each other to form a stacked multilayer cable with said branch sections extending from said woven sections for programmed termination.

6. The cable of claim 5 including woven selvages formed alongside a number of woven cable sections from which said electrical conductors have been broken out formed by weaving the warp strands from a first of said cable sections with said weft yarn alongside a second of said cable sections.

7. A method of constructing a woven electrical transmission cable having a plurality of electrical conductors for programmed termination in either a single layer or multilayer configuration, comprising:

(a) weaving warp and weft yarns in a prescribed weave pattern to bind a plurality of electrical conductors extending in a warp direction to create a plurality of woven cable sections in said cable;

(b) weaving a plurality of individual woven cable sections which are discrete across the width of said cable and extend longitudinally in said cable;

(c) weaving weft and warp yarns in adjacent sections 180 degrees out of phase with respect to each other so that one section is weaving while an adjacent section is not weaving;

(d) criss-crossing top and bottom picks of said weft yarn between adjacent sections to form a hinge-line; and (e) forming conductor branches by breaking out the electrical conductors from each woven cable section at successive lengths of said cable in a generally unbound configuration in which they are not woven with said warp and weft yarns while continuing to weave said warp and weft yarns in the other of said cable sections at successive lengths of said cable.

8. The method of claim 7 including breaking out a first number of said electrical conductors from a first cable section to form a first conductor branch in which said conductors are generally unbound with said warp and weft yarns; weaving said warp yarns from said first cable section with said weft yarn in a woven selvage along a second cable section in which a second number of said plurality of electrical conductors remain bound; and breaking out said second number of conductors from said second cable section to form a second conductor branch.

9. The method of claim 8 including weaving a woven tab section which includes said warp yarns from said first and second cable sections woven with said weft yarn; and weaving a final woven section which includes a third number of said plurality of electrical conductors remaining bound with said warp and weft yarns; and breaking out said third number of conductors to form a third conductor branch with said third number of electrical conductors being unbound with said warp and weft yarns.

10. The method of claim 9 including folding said first, second, and third cable sections about said hinged lines on top of each other to form a multilayer stacked cable.

11. The method of claim 7 including breaking out a first number of said plurality of electrical conductors from a first cable section to form a first conductor branch in which said conductors are not woven with said warp and weft yarns; weaving said warp yarns from said first cable section with said weft yarn in a woven selvage along a second woven cable section in which a second number of said plurality of electrical conductors are bound with warp and weft yarns; and continuing the breaking out of bound electrical conductors from a corresponding cable section along the length of said woven cable until a desired number of conductor branches are broken out from said cable.

12. A method of weaving a multilayer woven electrical transmission cable comprising:

(a) weaving a plurality of longitudinally extending woven cable sections forming a cable which include a plurality of elongated electrical conductors extending in the warp direction bound with warp and weft yarns in a prescribed weave pattern;

(b) crossing said weft yarn alternately over and under next adjacent cable sections on each pick of said weft yarn to form a hinge-line between adjacent woven cable sections to facilitate folding of said woven sections on top of each other; and (c) breaking out conductors from said woven cable sections at successive lengths of said cable which include electrical conductors from said cable sections being unwoven while continuing to weave said warp and weft yarns in the other of said cable sections at successive lengths of said cable.

13. A method of weaving a multilayer woven electrical transmission cable comprising:

(a) forming a plurality of woven cable sections by weaving a plurality of warp yarns and a weft yarn together with longitudinal electrical conductors extending in a warp direction in a prescribed weave pattern to form a cable;

(b) weaving a first woven cable section containing a first number of said plurality of electrical conductors;

(c) breaking out said first number of elongated electrical conductors from said first woven cable section into a first conductor branch in which said electrical conductors are not woven with said warp and weft strands;

(d) weaving a second woven cable section containing a second number of said plurality of electrical conductors woven with said warp and weft yarns after breaking out said first number of electrical conductors;

(e) breaking out the second number of electrical conductors from said second cable section into a second conductor branch in which said second number of elongated conductors are generally unbound with said warp and weft yarns;

(f) weaving a third woven cable section containing a third number of said plurality of electrical conductors woven with said warp and weft yarns after breaking out said second number of electrical conductors;

(g) breaking out the third number of electrical conductors of said third woven cable section into a third branch section in which said electrical conductors are generally unbound with said warp and weft strands; and (h) weaving said first, second, and third woven section 180 degrees out of phase with respect to each other wherein said first and third sections are woven while said second section is not woven.

14. The method of claim 13 including weaving a selvage along said second woven cable section which includes the warp strands from said first cable section woven with the picks of the weft yarns of said second cable section.

* * * * *